US011725388B2

(12) United States Patent
Hong et al.

(10) Patent No.: US 11,725,388 B2
(45) **Date of Patent: *Aug. 15, 2023**

(54) POST-FUNCTIONALIZED ROOFING GRANULES AND PROCESS FOR PREPARING SAME

(71) Applicant: CertainTeed LLC, Malvern, PA (US)

(72) Inventors: Keith C. Hong, Litiz, PA (US); Gregory F. Jacobs, Oreland, PA (US); Van Nhan Nguyen, Paris (FR)

(73) Assignee: CertainTeed LLC, Malvern, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/335,782

(22) Filed: Jun. 1, 2021

(65) Prior Publication Data

US 2021/0285220 A1 Sep. 16, 2021

Related U.S. Application Data

(63) Continuation of application No. 16/394,868, filed on Apr. 25, 2019, now Pat. No. 11,021,877, which is a continuation of application No. 14/526,480, filed on Oct. 28, 2014, now abandoned, which is a continuation of application No. 11/924,805, filed on Oct. 26, 2007, now abandoned.

(60) Provisional application No. 60/912,830, filed on Apr. 19, 2007.

(51) Int. Cl.
*E04D 7/00* (2006.01)
*B05D 7/00* (2006.01)

(52) U.S. Cl.
CPC ..... *E04D 7/005* (2013.01); *B05D 7/576* (2013.01); *Y10T 428/24975* (2015.01); *Y10T 428/2991* (2015.01); *Y10T 428/2993* (2015.01); *Y10T 428/2995* (2015.01); *Y10T 428/2996* (2015.01)

(58) Field of Classification Search
None
See application file for complete search history.

(56) References Cited

U.S. PATENT DOCUMENTS

| | | | |
|---|---|---|---|
| 1,943,525 | A | 1/1934 | Gundlach |
| 2,057,677 | A | 10/1936 | Gundlach |
| 2,057,678 | A | 10/1936 | Gundlach |
| 2,057,679 | A | 10/1936 | Gundlach |
| 2,133,728 | A | 10/1938 | Teetor |
| 2,379,358 | A | 6/1945 | Jewett |
| 2,417,058 | A | 3/1947 | Buzzell |
| 2,591,149 | A | 4/1952 | Grove |
| 2,614,051 | A | 10/1952 | Buzzell |

(Continued)

FOREIGN PATENT DOCUMENTS

JP 2004-162482 A 6/2004

OTHER PUBLICATIONS

Handbook of Mineralogy, vol. II, Mineral Data Publishing, v.1.2 (2001), Dickite.

(Continued)

*Primary Examiner* — Ronak C Patel
(74) *Attorney, Agent, or Firm* — McDonnell Boehnen Hulbert & Berghoff LLP

(57) ABSTRACT

Roofing granules having a color coating layer are covered with a clear, transparent or translucent outer coating composition including a functional material, such nanoparticles of anatase titanium dioxide.

18 Claims, 1 Drawing Sheet

(56) References Cited

U.S. PATENT DOCUMENTS 2,695,851 A 11/1954 Lodge
2,732,311 A 1/1956 Hartwright
2,898,232 A 8/1959 Miller
2,927,045 A 3/1960 Lodge
2,981,636 A 4/1961 Lodge
2,986,476 A 5/1961 Larrsen
3,255,031 A 6/1966 Lodge
3,507,676 A 4/1970 McMahon
4,092,441 A 5/1978 Meyer
4,218,502 A 8/1980 Graham
4,378,408 A 3/1983 Joedicke
4,916,014 A 4/1990 Weber
5,240,760 A 8/1993 George
5,356,664 A 10/1994 Narayan et al.
5,380,552 A 1/1995 George
5,382,475 A 1/1995 Kayser
5,411,803 A 5/1995 George
5,484,477 A 1/1996 George
5,516,573 A 5/1996 George
5,573,782 A 11/1996 Bigham
5,595,813 A 1/1997 Ogawa
5,723,516 A 3/1998 Bigham
5,783,506 A 7/1998 Eppler
5,795,389 A 8/1998 Koschitsky
5,962,143 A 10/1999 Krauthauser
6,037,289 A 3/2000 Chopin
6,143,318 A 11/2000 Gilchrist
6,214,466 B1 4/2001 Joedicke
6,245,381 B1 6/2001 Israel
6,245,850 B1 6/2001 Fields
6,306,796 B1 10/2001 Suzue
6,362,121 B1 * 3/2002 Chopin ..... C03C 17/256 252/588
6,366,397 B1 4/2002 Genjima
6,376,075 B1 4/2002 Tacke-Willemsen
6,426,309 B1 7/2002 Miller
6,458,145 B1 10/2002 Ravenscroft
6,465,088 B1 10/2002 Talpaert
6,500,555 B1 12/2002 Khaldi
6,531,200 B2 3/2003 Zickell
6,548,145 B2 * 4/2003 Joedicke ..... C09C 1/3661 428/404
6,569,520 B1 5/2003 Jacobs
6,572,784 B1 6/2003 Coombs
6,607,781 B2 8/2003 Joedicke
6,610,135 B1 8/2003 Ohmori
6,653,356 B2 11/2003 Sherman
6,680,134 B2 1/2004 Maurer
6,692,824 B2 2/2004 Benz
6,703,127 B2 3/2004 Davis
6,881,701 B2 4/2005 Jacobs
6,881,702 B2 4/2005 Arnold
6,933,007 B2 8/2005 Fensel
7,060,658 B2 6/2006 Joedicke
7,238,408 B2 7/2007 Aschenbeck
7,241,500 B2 7/2007 Shiao
2001/0006933 A1 7/2001 Nagasaki et al.
2002/0005145 A1 1/2002 Sherman
2002/0160151 A1 10/2002 Pinault
2003/0068469 A1 4/2003 Aschenbeck
2003/0091795 A1 5/2003 Kiik
2003/0091814 A1 5/2003 Benz
2003/0152747 A1 8/2003 Fensel
2004/0010639 A1 6/2004 Joedicke
2004/0120884 A1 * 6/2004 Sherman ..... B01J 35/0013 423/608
2004/0255548 A1 12/2004 Hong
2004/0258835 A1 12/2004 Hong
2005/0053745 A1 3/2005 Bartek
2005/0053746 A1 3/2005 Bartek
2005/0072110 A1 4/2005 Shiao
2005/0072114 A1 * 4/2005 Shiao ..... E04D 5/12 52/782.1
2006/0251807 A1 11/2006 Hong
2007/0065640 A1 3/2007 Joedicke
2007/0065641 A1 3/2007 Joedicke
2008/0008858 A1 * 1/2008 Hong ..... E04D 1/22 428/141
2008/0131664 A1 6/2008 Teng

OTHER PUBLICATIONS

Handbook of Mineralogy, vol. II, Mineral Data Publishing, v.1.2 (2001), Kaolinite.

* cited by examiner

POST-FUNCTIONALIZED ROOFING GRANULES AND PROCESS FOR PREPARING SAME

CROSS-REFERENCE TO RELATED APPLICATIONS

The present application is a continuation of U.S. patent application Ser. No. 16/394,868, filed Apr. 25, 2019, now U.S. Pat. No. 11,021,877, which is a continuation of U.S. patent application Ser. No. 14/526,480, filed Oct. 28, 2014, now abandoned, which is a continuation of U.S. patent application Ser. No. 11/924,805, filed Oct. 26, 2007, now abandoned, which claims the benefit of U.S. Provisional Application Ser. No. 60/912,830 filed Apr. 19, 2007. The entirety of each of the foregoing applications is hereby incorporated by reference into the present application.

BACKGROUND OF THE INVENTION

1. Field of the Invention

The present application relates to roofing granules and roofing products including roofing granules.

2. Brief Description of the Prior Art

Asphalt shingles are conventionally used in the United States and Canada as roofing and siding materials. Roofing granules are typically distributed over the upper or outer face of such shingles. The roofing granules, in general formed from mineral materials, serve to provide the shingle with durability. They protect the asphalt from the effects of the solar radiation (in particular from the degradative effects of ultraviolet rays) and of the environment (wind, precipitation, pollution, and the like), and contribute to better reflection of incident radiation. The granules moreover are typically colored, naturally or artificially by way of the application of pigments, to meet the aesthetic requirements of the user.

However, it is not unusual to see unattractive green, brown or black spots appearing on the surface of asphalt shingles of buildings located in temperate climates. These spots are due to micro-organisms, mainly algae of the *Gloeocapsa* genus which benefit from conditions favorable to their growth found in temperate climates. These conditions include heat, moisture and nutrients. The essential biogenic salts may be provided by the mineral granules themselves, but also may be supplied by organic matter which settles on the shingles. The unattractiveness of these spots, all the more noticeable when the color of the shingle is a light one, is not the only disadvantage. In addition, the resulting darkening of the surface causes an increase in the absorption of the solar radiation, which in turn reduces the effectiveness of the shingles as thermal insulation, and decreases their service life.

To address this problem, algae-contaminated shingles can be treated with suitable biocides. However, the complete elimination of the algae is difficult, and requires the treatment of the entire building, including seemingly healthy surfaces. Even by using a powerful biocide such as sodium hypochlorite, the prophylactic effect is not permanent, because the roof is subsequently scrubbed by weather-borne water. Moreover, certain green algae particularly resistant to biocides can re-colonize previously treated surfaces, thus requiring additional treatments, at regular intervals, to limit their reappearance.

Other methods known to prevent the appearance of the undesirable algae growth are based on the incorporation of algaecide in the shingle. For example, it has been suggested that granules include metal compounds in the form of zinc oxide or sulfide (U.S. Pat. No. 3,507,676), or copper oxide (U.S. Pat. No. 5,356,664), or that a mixture copper oxide and zinc oxide (U.S. Patent Publication 2002/0258835 and U.S. Patent Publication 2002/0255548) be incorporated in the asphalt.

It has also been suggested to disperse a granular or pulverulent material containing an algaecide on the surface of the shingle (JP-A-2004162482).

U.S. Pat. No. 6,245,381 suggests adding a biocide in the form of salt or of chelate starting from $Cu^{2+}$, $Zn^{2+}$ and $Sn^{2+}$ ions complexed with an organic binder anion in asphalt during the manufacture of the shingle.

Another approach has been to employ photocatalytic particles as biocidal agents. The photocatalytic effect has been employed to provide self-cleaning glass and other ceramic materials. For example, U.S. Pat. No. 6,037,289 discloses a substrate provided with photocatalytic anatase titanium dioxide that is at least partially crystalline, and has a mean size of between 5 and 80 nm. The coating can include an inorganic binder, such as an amorphous or partially crystalline oxide, or mixture of oxides, such as oxides of silicon, titanium, tin, zirconium or aluminum, which can serve as a matrix for the photocatalytic titanium oxide. Alternatively, a partly organic binder can be used, such as a binder based on epoxide-containing alkoxysilanes. Similarly, U.S. Pat. No. 6,465,088 discloses a substrate such as a glass or acrylate glazing material covered with a photocatalytic coating including crystallized particles having photocatalytic properties and a mineral binder comprising at least one oxide of a metal having photocatalytic properties. U.S. Pat. Nos. 6,569,520 and 6,881,702 disclose a photocatalytic composition and method for preventing algae growth on building materials such as roofing granules. A plurality of photocatalytic particles, such as anatase titanium dioxide, is dispersed in a silicate binder to form an exterior coating for a substrate such as a roofing granule or concrete surface. At least a portion of some of the photocatalytic particles is exposed on the surface of the coating.

In general all these approaches aim to provide biocide at the surface of the roofing granules, but also require significant deviations from the conventional techniques for producing such granules, such as formulating, applying and curing one or more interior coatings including biocidal materials, adding functional components such as various biocidal materials to the exterior color coating composition used to provide color to the granules and the roofing shingles formed with such granules, and the like.

Functional materials are substances that confer special or desirable properties when added to a composition, such as coating composition. Biocides are an example of one class of functional materials. Another type of functional material encountered in the roofing granule art enhances the solar reflectance of the roofing granules. Some materials may have multiple functional characteristics.

Colored granules have been modified using functional materials to provide special functions to the granules and the shingles or membranes that contain these granules. The most common feature is algae resistance which relies on the metal oxides, such as cuprous oxide, to serve as the algaecides. Solar reflectance is another feature that has been added to the roofing granules by incorporating solar reflective or solar transparent pigments. The major disadvantage of these types of functionalized colored granules is the high cost—usually 10 to 20-fold more expensive than the standard colored granules. The main reason is a combination of complicated manufacturing processes in order to achieve the desired colors and properties, plus the high costs of raw materials (algaecides and/or solar reflective pigments).

There is a great need for roofing granules to possess an appealing color appearance and to increase functionalities, but remain cost effective.

Further, there is a continuing need to prevent the appearance of undesirable algae growth on roofing shingles and other roofing materials in an efficient and cost-effective manner.

SUMMARY OF THE INVENTION

The present invention provides for the addition of special functionalities to standard "commodity" colored granules. In the process of the present invention, colored roofing granules prepared by the conventional coloring process, commonly referred as the "pan coating process," are used as starting core materials. A functionalized outer coating layer that is clear, transparent, or translucent is applied over the colored granules, preferably without significantly altering the original color of the granules. As a result, the costly color matching process that would be otherwise required can be avoided. The conventional pan coating coloring process can be used to apply the outer layer. However, other coating process, such as fluidized bed coating processes, can be used to provide the outer coating layer, but with greater coating coverage and efficiency than the conventional pan coating process. Different coating or binder materials such as those based on siliceous materials (alkali metal silicate, alkali earth metal silicate and various silica chemistries), titanates, zirconates, metal phosphates or polymers can also be used to provide the outer layer.

Thus, in one aspect, the present invention provides a process for preparing functionalized roofing granules. This process comprises providing base roofing granules having a first coating layer which includes at least one coloring material. The process further comprises coating the base roofing granules with outer coating composition that provides a clear, transparent or translucent outer coating. The outer coating composition comprises an outer coating binder and at least one functional material. The process also comprises curing the outer coating composition to form a clear, transparent or translucent outer coating layer on the base roofing granules. Preferably, the outer coating binder is selected from the group consisting of binders including at least one alkali metal silicate, binders including at least one alkaline earth metal silicate, binders including colloidal silica, binders including at least one metal phosphate, and binders including at least one organic polymer. Preferably, the at least one organic polymer is selected from the group consisting of polyurethane polymers, silane or siliconized polymers, sulfo-urethane silanol-based polymers, and acrylic polymers. In addition, when a particulate material is employed as the at least one functional material, in order to minimize light scattering and increase the transparency or translucency of the outer coating layer, it preferred that the at least one functional material be a particulate having an average particle size less than 0.2 microns. Alternatively, the at least one functional material can have a refractive index near the refractive index of the binder in the wave length range of the visible spectrum. In one presently preferred embodiment, it is preferred that the at least one functional particulate material have biocidal activity, such as nano titanium dioxide materials. In another presently preferred embodiment, it is preferred that the at least one functional particulate material has a solar reflectance greater than about 25 percent, more preferably greater than about 35 percent, and even more preferable greater than about 50 percent. Preferably, in one presently preferred embodiment of the process of the present invention, the outer coating composition comprises a colloidal silica binder and photocatalytic anatase titanium dioxide dispersed in the binder, and the outer coating composition is cured at an elevated temperature.

In another aspect, the present invention provides a process for preparing functionalized roofing granules in which the process comprises two additional steps. In this aspect, the process steps include providing base roofing granules having a first coating layer wherein the first coating layer includes at least one coloring material. However, in this aspect the process also includes the step of coating the base roofing granules with a second coating composition to form a second coating layer over the first coating layer, and the step of curing the second coating composition having a second coating layer on the base roofing granules to form intermediate granules. In this aspect, the process of the present invention also includes coating the intermediate granules with an outer coating composition that provides a clear, transparent or translucent outer coating, wherein the outer coating composition comprises an outer coating binder and at least one functional material, and curing the outer coating composition to form a clear, transparent or translucent outer coating layer on the base roofing granules. In this aspect, the first coating composition preferably provides a first coating layer comprising silicon dioxide. Preferably, the outer coating composition comprises a colloidal silica binder and photocatalytic anatase titanium dioxide dispersed in the binder, and the outer coating composition is cured at an elevated temperature.

The present invention in one aspect also provides functionalized roofing granules comprising base roofing granules having a first coating layer, the first coating layer including at least one coloring material; and a clear, transparent or translucent outer coating layer comprising an outer coating binder and at least one functional material. Preferably, the outer coating binder is selected from the group consisting of binders including at least one alkali metal silicate, binders including at least one alkaline earth metal silicate, binders including colloidal silica, binders including at least one metal phosphate, binders including at least on titanate, binders including at least one zirconate, and binders including at least one organic polymer. Preferably, the at least one functional material is a particulate having an average particle size less than 0.2 microns. In one presently preferred embodiment, the at least one functional particulate material has biocidal activity. In another presently embodiment, the at least one functional particulate material imparts a solar reflectance greater than about 25 percent, preferably greater than about 35 percent, and more preferably greater than about 50 percent, to the finished covering on the granule. Preferably, the outer coating composition comprises a colloidal silica binder and photocatalytic anatase titanium dioxide dispersed in the binder, and the outer coating composition is cured at an elevated temperature. Preferably, the at least one organic polymer is selected from the group consisting of polyurethane polymers, acrylic polymers, polyurea polymers, silicone polymers, siliconized polymers, and sulfo-urethane silanol-based polymers.

In another aspect, the present invention provides functionalized roofing granules comprising base roofing granules having a first coating layer, the first coating layer including at least one coloring material, a second coating layer over the first coating layer, and a clear, transparent or translucent outer coating layer comprising an outer coating binder and at least one functional material. Preferably, the first coating layer comprises silicon dioxide. It is also preferred in this aspect of the functionalized roofing granules of the present invention that the outer coating layer comprises a silica binder and photocatalytic anatase titanium dioxide dispersed in the binder.

In another aspect, the present invention provides functionalized roofing granules comprising base roofing granules, and a coating layer over the base roofing granules, the coating layer comprising a coating binder, at least one coloring material, and at least one functional material.

In yet another aspect, the present invention provides functionalized roofing granules comprising base roofing granules having a first coating layer, the first coating layer including at least one coloring material including an organic compound or ligand. The functionalized roofing granules further comprise a second coating layer over the first coating layer, as well as a clear, transparent or translucent outer coating layer comprising an outer coating binder and at least one photocatalytic functional material. The second coating layer is preferably formulated as a barrier coating between the first coating layer and the outer coating layer. The at least one coloring material can be a phthalocyanine derivative such as a phthalocyanine blue or phthalocyanine green.

DETAILED DESCRIPTION

Figure 1:
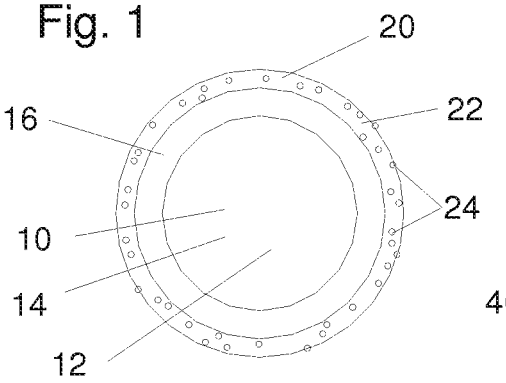
FIG. 1 is a schematic illustration of a first type of post-functionalized roofing granule according to the present invention.
Figure 2:
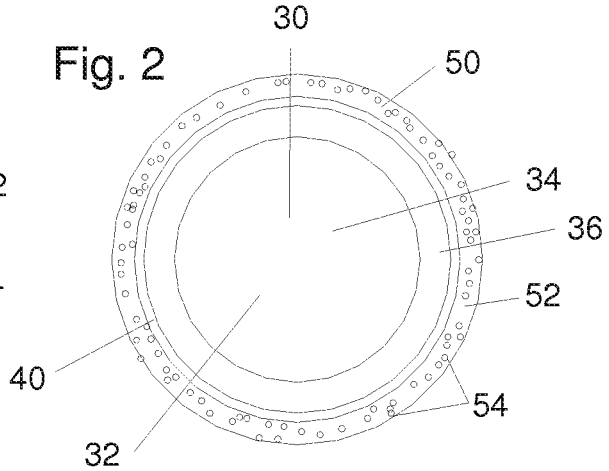
FIG. 2 is a schematic illustration of a second type of post-functionalized roofing granule according to the present invention.

Referring now to the drawings, in which like reference numerals refer to like elements in each of the several views, there are shown schematically in FIGS. 1 and 2 examples of post-functionalized roofing granules according to the present invention.

FIG. 1 is a schematic representation of a first type of post-functionalized roofing granule 10 of the present invention. FIG. 1 schematically illustrates a functionalized granule 10 including a base roofing granule 12 covered with a transparent or translucent outer coating layer 20. The base roofing granule 12 includes an inert mineral core particle 14 covered with a color coating layer 16 containing a metal oxide colorant, such as iron oxide, dispersed in a ceramic silicaceous matrix. Surrounding and covering the color coating layer 16 is a clear, transparent or translucent outer coating layer 20 comprising an outer coating binder 22 in which are dispersed particles of a functional material 24, such as nanoparticles of anatase titanium dioxide. The outer coating binder 22 can be a ceramic material such as a silica glass or glaze or a crystalline ceramic material. Alternatively, the outer coating binder 22 can be an organic polymeric material such as a polyurethane polymer, an acrylic polymer, a polyurea polymer, a silicone polymer, a siliconized polymer, or a sulfo-urethane silanol-based polymer. In either case, the outer coating binder 22 is preferably clear, transparent or translucent, so that the appearance of the color coating layer 16 is not significantly altered by the outer coating binder 22. Preferably, the dispersed particles of functional material 24 are sized so that the dispersed particles do not scatter incident visible light significantly.

FIG. 2 is a schematic representation of a second type of post-functionalized roofing granule 30 of the present invention. FIG. 2 also schematically illustrates a functionalized granule 30 including a base roofing granule 32 covered with a transparent or translucent outer coating layer 50. As in the case of the first type of post-functionalized roofing granule, the base roofing granule 32 includes an inert mineral core particle 34 covered with a color coating layer 36 containing a metal oxide colorant, such as chromium oxide, dispersed in a ceramic silicaceous matrix. In this case, however, there is a second coating layer 40 surrounding and covering the color coating layer 36, and the outer coating layer 50 surrounds and covers the second coating layer 40. The second coating layer 40 serves as a barrier layer between the color coating layer 36 and the outer coating layer 50, and can be formed from a silica glass or crystalline silicaceous material. Both the second coating layer 40 and the outer coating layer 50 are preferably transparent or translucent to visible light. As in the first type of post-functionalized roofing granule, the outer coating layer 50 includes an outer coating binder 52 in which are dispersed particles of a functional material 54, such as nanoparticles of anatase titanium dioxide. Further, the outer coating binder 52 can be a ceramic material such as a silica glass or glaze or a crystalline ceramic material, or an organic polymeric material such as a polyurethane polymer, an acrylic polymer, a polyurea polymer, a silicone polymer, a siliconized polymer, or a sulfo-urethane silanol-based polymer.

The base roofing granules include a mineral core which can consist of any chemically inert matter having moreover mechanical properties enabling the mineral core to resist the various operations implemented during the manufacture of the asphalt shingles. For examples, the mineral core can be formed from materials available in the natural state, such as ceramic grog, talc, granite, siliceous sand, andesite, porphyry, marble, syenite, rhyolite, diabase, quartz, slate, basalt, sandstone, and marine shells, as well as material derived from recycled manufactured goods, such as bricks, concrete, and porcelain.

The mineral core can be provided as granules, generally obtained by crushing above mentioned materials and sifting of the products obtained, having a size of particle, taken in its greatest dimension, ranging between about 0.2 and 3 mm, preferably between about 0.4 and 2.4 mm, and more preferably about 1 mm. The mineral core can have a form approaching that of a sphere, but it can also have the shape of a plate or flake, that is, of a relatively planar element of little thickness compared to its surface.

Preferably, the mineral core has a low porosity, defined in particular as having an average pore volume less than about $1\times10^3$ $cm^3/g$ measured for pores having an average diameter of less than 70 nm.

Preferably, the average mass of the particles forming the mineral core generally lies between about 0.05 mg and 15 mg, and preferably between about 0.3 mg and 7 mg.

In one presently preferred embodiment of the present invention, before being covered by the clear, transparent or translucent outer layer, the mineral core undergoes one or more operations to provide the color coating layer, in particular by the application of one or more layers of colored coating including a binder, such as an alkali metal silicate, and one or more compounds of the color desired, for example selected among the pigments of metallic oxides and carbon black. The techniques for application of such colored layers are well-known in the roofing granule art. The colored coating layer can also include at least one metal oxide, such as copper oxide, zinc oxide, or a mixture thereof, as an optional biocidal material.

In another embodiment of the present invention, the mineral core employed has suitable color characteristics, and a colored coating layer is not required, and a clear, transparent, or translucent coating layer, comprising a coating binder in which particles of functional material are dispersed, is applied directly to the mineral core.

In one presently preferred embodiment of the present invention, the clear, transparent or translucent outer layer is functionalized by dispersing at least one photocatalytic metal oxide in the outer layer coating composition. In another embodiment of the present invention, the clear, transparent or translucent outer layer is functionalized by dispersing at least one solar reflective material in the outer layer coating composition. In yet another embodiment of the present invention, the clear, transparent or translucent outer layer is functionalized by dispersing at least one colorant or dye in the outer layer coating composition. In yet another embodiment of the present invention, the clear, transparent or translucent outer layer in functionalized by dispersing both at least one photocatalytic metal oxide and at least one solar reflective material in the outer layer coating composition. In yet another aspect, the clear, transparent or translucent outer layer is functionalized by dispersing both at least one photocatalytic metal oxide and at least one colorant or dye in the outer layer coating composition. In another aspect, the clear, transparent or translucent outer layer is functionalized by dispersing at least one photocatalytic metal oxide, at least one solar reflective material, and at least one colorant or dye in the outer layer coating composition. In some instances, a single material can provide more than a single function, such as, for example, by serving both as a solar reflective material and as a colorant in the visible range, or as photocatalytic metal oxide and as a colorant.

In one aspect, the present invention provides a sol-gel process for preparing the outer layer of the post-functionalized roofing granules. This process includes the steps of providing a base roofing granule having mineral core and a color coating layer, preparing a functionalized sol comprising at least one inorganic precursor material, coating the mineral core with the sol of inorganic precursor material, forming a coating layer on the mineral core from the sol of inorganic precursor material.

Formation of the inorganic material from the inorganic precursor material by the sol-gel method is well-known in the art. As is understood in the art, a "sol" is a dispersion of colloidal particles dispersed in a liquid; and by "gel" is a network of polymeric chains. Conventionally, the sol-gel method as applied to film formation on a target surface is understood to include the steps of forming a sol of colloidal particles of inorganic precursor material dispersed in a liquid carrier; applying the sol of colloidal particles to surface to be covered (i.e. film deposition); gelling the mixture on the surface so as to form a three-dimensional network of colloidal particles and a network of pores (i.e. a xerogel), and eliminating the liquid phase to obtain a thickening or the chemical stabilization of the network of pores and formation of a film on the surface to be covered. The physics and chemistry of the sol-gel method are reviewed in C. Jeffrey Binker et al., *Sol-Gel Science* (Academic Press Boston 1990). The sol of inorganic precursor material can also include a sacrificial template material, which is removed after film formation to provide the pore network. In the absence of a template material, control of the size and extent of aggregation of the colloidal particles of inorganic precursor material during film deposition, and control of the relative rates of condensation and evaporation of the liquid carrier, determines the characteristics of the pore network so formed, including the pore volume of the coating layer, the pore size, and the surface area of the pores. Conversely, when a template material is included in the sol of inorganic precursor material, the nature and amount of the template material affects the characteristics of the pore network obtained.

According to one presently preferred embodiment, the post-functionalized granules of the present invention are obtained by treating a substrate of base roofing granules with a sol including the inorganic precursor and the functional material, then drying at a temperature ranging between about 20 and 80 degrees C., preferably between about 40 with 70 degrees C., and more preferably between about 50 and 65 degrees C. This embodiment makes it possible to obtain in a single stage a post-functionalized granule with an outer coating layer.

In one aspect of the process of the present invention, the substrate employed is a conventional colored roofing granule, and a single coating layer is formed on the surface of the colored roofing granule. In this case, the sol includes both the inorganic precursor material and the functional material, such as, for example, at least one photocatalytic metal oxide.

In yet another aspect of the process of the present invention, the substrate employed is an algae-resistant roofing granule, and a single outer coating layer is formed on the surface of the algae-resistant roofing granule. Algae-resistant roofing granules typically include at least one non-photocatalytic algaecidal metal oxide, preferably copper oxide and/or zinc oxide, in at least one coating layer on their mineral cores. Algae-resistant roofing granules are disclosed, for example, in U.S. Pat. Nos. 3,507,676, 4,092,441, 5,356,664, 6,124,466 each incorporated herein by reference. In this case, the sol includes both the inorganic precursor material and the functional material, such as, for example, at least one photocatalytic metal oxide, and/or a dye or colorant.

In another aspect of the process of the present invention, the substrate employed, which can be a mineral core, or a conventional colored roofing granule, is provided with "post-functional" algae-resistance by including a quaternary ammonium silane in the binder of the outer coating layer. Alternatively, an inner layer formed from a precursor material including a quaternary ammonium silane such as N-trimethoxysilylpropyl-N,N,N-trimethylammonium chloride, is first formed on the surface of the substrate, followed by an outer coating layer according to the present invention.

In another aspect of the process of the present invention, the substrate employed, which can be a mineral core, a conventional colored roofing granule, or an algae-resistant roofing granule, is covered with a sodium ion barrier layer prior to application of the single mesoporous coating layer to the surface of the substrate. As is known in the art, sodium ions tend to interfere with or "poison" the beneficial photocatalytic action of the at least one photocatalytic metal oxide. The preparation and deposition of sodium ion barrier coating is disclosed, for example, in U.S. Pat. Nos. 6,362,121 and 6,465,088, each incorporated herein by reference.

In still another aspect of the process of the present invention, the substrate employed, which can be a conventional colored roofing granule, or an algae-resistant roofing granule, or a substrate including a sodium ion barrier layer, is first coated with one or more initial or inner coating layers, which may optionally include functional material such as, for example, at least one photocatalytic metal oxide. Preferably, however, in this aspect of the process of the present invention, the one or more inner layers does not include the functional material, and is instead provided to increase the ultimate thickness of the outer layer on the exterior of the substrate. However, in depositing the outermost layer, the sol includes both the inorganic precursor material and the functional material.

In still another aspect of the process of the present invention, the substrate employed, which can be a conventional colored roofing granule, or an algae-resistant roofing granule, or a substrate including a sodium ion barrier layer, the outer coating layer is formed so as to provide a gradient in the concentration of the functional material. For example, a plurality of coating sublayers can be provided, in which the concentration of the functional material increased with each successive sublayer applied, so that the concentration of the function material is greatest in the outermost sublayer of the outer coating layer.

In another aspect of the present invention, the substrate comprises a roofing material, such as the upper or outer surface of a roofing shingle surfaced with roofing granules, such as conventional colored roofing granules, algae-resistant roofing granules, or a mixture thereof, or such a roofing material covered with an initial or inner coating layer, and a single outer coating layer is formed on the substrate. In this case, the sol includes both the inorganic precursor material and the functional material such as at least one photocatalytic metal oxide.

The sol employed in the process of the present invention is preferably an aqueous suspension including one or more inorganic precursors selected from alkylsilanes, and alkoxysilanes, including tetralkoxysilanes, such as tetramethoxysilane (TMOS), tetraethoxysilane (TEOS), tetra-n-propoxysilane, tetra-n-butoxysilane, and tetrakis(2-methoxyethoxy)silane, oraganotrialkoxysilanes such as methyltriethoxysilane (MTEOS), methyltrimethoxysilane, methyl tri-n-propoxysilane, phenyl triethoxysilane, and vinyl triethoxysilane, siloxane oligomers such as hexamethoxydisiloxane, and octamethoxytrisiloxane; aluminum alkoxides such as aluminum tributoxide, titanium alkoxides such as titanium tetraethoxide and titanium tetraisopropoxide, zirconium alkoxides such as zirconium tetraethoxide, aluminum chloride, zirconyl chloride, organozirconates, organotitanates, and the like. Conventionally, the sol is treated with acid, preferably at a temperature ranging between about 20 and 100°C and in the presence of an alcohol such as ethanol, for sufficient length of time to obtain the conversion of the inorganic precursor into corresponding metallic oxide.

In addition, the outer coating layer can be formed from a vitreous silica material, such as a vitreous glaze, in which is dispersed functional material. The vitreous glaze can be formed from a vitreous flux, particulate silica glass, or a mixture thereof, in which is dispersed the functional material. Conventional vitreous coating compositions such as vitreous coating compositions including particulate silica glass or frit, an organic or inorganic suspending agent such as clay or fumed silica for suspending the functional material, and a binder such as a methylcellulose, gum or starch, can be employed. The base roofing granules are coated with the vitreous flux or particulate silica glass using conventional methods, and the coated roofing granules are then heated to an elevated temperature sufficient to fuse the vitreous flux or particulate glass and form an outer coating containing the functional material on the base roofing granules.

In the alternative, the binder employed to form the outer coating layer can be a polymeric organic material, such as a copolymer composed of acrylic monomers, or a polyurethane material. Preferably, the polymer organic material is selected from the group consisting of polyurethane polymers, acrylic polymers, polyurea polymers, silicone polymers, siliconized polymers, and sulfo-urethane silanol-based polymers. Preferably, the monomer composition of the polymer or copolymer is selected to provide a glass transition temperature (Tg) above the highest environmental temperatures expected to be experienced during the service life of the post-functionalized roofing granules. In the case of a crosslinked polymer system, preferably the glass transition temperature of the crosslinked polymer network is above the maximum anticipated in use temperatures of the post-functionalized granules.

Provided that the functional material in the outer layer has biocidal activity, the post-functionalized roofing granules of the invention can be used to control the development of micro-organisms, in particular of algae, in or on roofing materials to limit the appearance of unappealing blotches and spots on the roofing materials. The roofing material can be an organic asphalt shingle, containing fibers of wood or cellulose, or glass fiber reinforced shingle.

The post-functionalized granules prepared according to the process of the present invention can be employed in the manufacture of post-functionalized roofing products, such as post-functionalized asphalt shingles, using conventional roofing production processes. Typically, bituminous roofing products are sheet goods that include a non-woven base or scrim formed of a fibrous material, such as a glass fiber scrim. Bituminous roofing products are typically manufactured in continuous processes in which a continuous substrate sheet of a fibrous material such as a continuous felt sheet or glass fiber mat is immersed in a bath of hot, fluid bituminous coating material so that the bituminous material saturates the substrate sheet and coats at least one side of the substrate. Thus, the substrate is coated with one or more layers of a bituminous material such as asphalt to provide water and weather resistance to the roofing product. The reverse side of the substrate sheet can be coated with an anti-stick material such as a suitable mineral powder or fine sand. The upper side of the roofing product is typically coated with mineral granules to provide durability, reflect heat and solar radiation, and to protect the bituminous binder from environmental degradation. The roofing granules are typically distributed over selected portions of the upper side of the substrate, and the bituminous material serves as an adhesive to bind the roofing granules to the sheet when the bituminous material has cooled.

The post-functionalized granules of the present invention can be mixed with conventional roofing granules, and the granule mixture can be embedded in the surface of such bituminous roofing products using conventional methods. The post-functionalized granules can be mixed with untreated granules to comprise less than about 10 percent by weight of the total granule weight, and preferably, less than 10 percent by weight.

Alternatively, post-functionalized granules of the present invention can be substituted for conventional roofing granules in the manufacture of bituminous roofing products to provide those roofing products with resistance to biological discoloration and degradation. One or more classes of the post-functionalized granules can be applied sequentially to the roofing product surface, optionally followed by application of conventional roofing granules. In one embodiment of the process of the present invention, a first class of post-functionalized granules is first applied to the surface of the roofing product, followed by application of a second class of post-functionalized granules, followed finally by application of conventional roofing granules. In another embodiment of the present invention, a mixture of two or more classes of post-functionalized granules is first applied to the surface of the roofing product, followed by application of conventional roofing granules. Given the order of application, any excess granules that are not successfully embedded in the surface of the roofing product are likely to be conventional granules. Thus, the order of application of these embodiments of the process of the present invention is likely to permit more precise loading of the roofing product surface with the classes of post-functionalized granules than otherwise. In yet another embodiment, one or more classes of post-functionalized granules are applied to the surface of the roofing product.

The roofing product sheet can be cut into conventional shingle sizes and shapes (such as one foot by three feet rectangles), slots can be cut in the shingles to provide a plurality of "tabs" for ease of installation and aesthetic effects, additional bituminous adhesive can be applied in strategic locations and covered with release paper to provide for securing successive courses of shingles during roof installation, and the finished shingles can be packaged. More complex methods of shingle construction can also be employed, such as building up multiple layers of sheets in selected portions of the shingle to provide an enhanced visual appearance, or to simulate other types of roofing products. Release strips can also be strategically applied to the shingles so as to line up with sealing adhesive so that stacked shingles can be packaged without the need for separate release paper covers for the additional adhesive.

The bituminous material used in manufacturing roofing products according to the present invention is derived from a petroleum processing by-product such as pitch, "straight-run" bitumen, or "blown" bitumen. The bituminous material can be modified with extender materials such as oils, petroleum extracts, and/or petroleum residues. The bituminous material can include various modifying ingredients such as polymeric materials, such as SBS (styrene-butadiene-styrene) block copolymers, resins, oils, flame-retardant materials, oils, stabilizing materials, anti-static compounds, and the like. Preferably, the total amount by weight of such modifying ingredients is not more than about 15 percent of the total weight of the bituminous material. The bituminous material can also include amorphous polyolefins, up to about 25 percent by weight. Examples of suitable amorphous polyolefins include atactic polypropylene, ethylene-propylene rubber, etc. Preferably, the amorphous polyolefins employed have a softening point of from about 130 degrees C. to about 160 degrees C. The bituminous composition can also include a suitable filler, such as calcium carbonate, talc, carbon black, stone dust, or fly ash, preferably in an amount from about 10 percent to 70 percent by weight of the bituminous composite material.

In asphalt shingles, the mass of roofing granules per unit of area generally lies between 0.5 and 2.5 $kg/m^2$, preferably between 1 and 2 $kg/m^2$.

The examples which follow make it possible to illustrate the invention without however limiting it.

Example 1

Commercially available black colored granules (No. 51 black colored granules, CertainTeed Corp., Norwood, Mass.) are used as the starting core materials. A colorless outer coating is applied over these black granules using the conventional coloring process (pan coating). The ingredients of this outer coating include colloidal silica solution (from the hydrolysis of tetraethyl orthosilicate (Sigma-Aldrich Co.) in acidic solution, followed by neutralization in an alkaline medium) containing photocatalytic anatase form of nano titanium oxide (typical particle size of 20 to 50 nm, Millennium Chemical). The coating is subsequently sintered at 400° C. for 30 minutes. Since these nanoparticles and the coating do not alter the original color of the core granules, the resulting granules are black colored granules which possess photocatalytic functionality manufactured using the simple pan coating process. There is only a slight visually perceptible difference in color between the two.

Example 2

Example 1 is repeated, except that the outer layer binder in this case is a clear or transparent polymeric material (polyacrylate). This outer layer is applied onto the black granules via the pan coating process. An organic algaecide is dispersed into the polymeric material to render the composite granules with algaecidal functionality while maintaining the original black color of the granules.

Example 3

Example 2 is repeated, except that the outer layer binder in this case is a transparent polyacrylate applied by a fluidized bed process to the base granules. Solar-reflective nano-titanium dioxide particles are dispersed in the polyacrylate prior to application to the base granules, such that the polymeric outer layer has a solar reflective functionality while the original black color of the granules is maintained.

Example 4

Example 3 is repeated, except that both an organic algaecide and solar-reflective nano-titanium dioxide particles are dispersed in the outer layer binder prior to application of the coating composition to the base granules, such that the polymeric outer layer has both algaecidal and solar reflective functionalities, while the original black color of the granules is maintained.

Example 5

Commercially available red colored granules (No. 22 red colored granules, CertainTeed Corp., Norwood, Mass.) are used as the starting core materials. The red color is provided by iron oxide pigment. A silica coating is place over the red base granules by a conventional process, namely pan coating, to form an intermediate barrier coating layer. Next, a colorless outer coating is applied over the intermediate barrier layer using the same conventional roofing granule coloring process. The components of the outer coating composition include colloidal silica solution (from the hydrolysis of tetraethyl orthosilicate in acidic solution, followed by neutralization in an alkaline medium) and photocatalytic anatase form of nano titanium oxide (typical particle size of 20 to 50 nm). The coating is subsequently sintered at 400° C. for 30 minutes. Since these nanoparticles and the coating do not alter the original color of the core granules, the resulting granules are red colored granules which possess photocatalytic functionality manufactured using the simple pan coating process.

Example 6

The process of Example 1 is repeated, except that commercially available blue-gray granules (No. 55 blue-gray colored granules, CertainTeed Corp., Norwood, Mass.) are used as the starting base granules, and the resulting post-functionalized granules are blue-gray in color.

Example 7

The process of Example 1 is repeated, except that commercially available yellowish tan colored granules (No. 46 yellow colored granules, CertainTeed Corp., Norwood, Mass.) are used as the starting base granules, and the resulting post-functionalized granules are yellow in color.

Example 8

The process of Example 2 is repeated, except that commercially available white granules (No. 93 white granules, CertainTeed Corp., Norwood, Mass.) are used as the starting base granules, and the resulting post-functionalized granules are white in color.

Example 9

The process of Example 8 is repeated, except commercially available white granules (No. 93 white granules, CertainTeed Corp., Norwood, Mass.) are substituted for the black granules, and a small amount of red iron oxide pigment is dispersed in the polymeric material prior to coating the base granules, such that while the base granules are white in color, the functionalized roofing granules are red.

Example 10

Blue-gray post-functionalized granule prepared according to Example 6 are sprayed with a dilute solution of rhodamine 6G solution (40 mg/liter of rhodamine 6G in water) to provide a rose color to the granules, dried overnight at room temperature under cover to prevent light exposure, and then exposed to UV-A irradiation.

Example 11

Commercially available green colored granules (CertainTeed Corp., Norwood, Mass.) are used as the starting core materials. The green color is provided by copper phthalocyanine pigment. A silica coating is place over the green base granules by a conventional process, namely pan coating, to form an intermediate barrier coating layer. Next, a colorless outer coating is applied over the intermediate barrier layer using the same conventional roofing granule coloring process. The components of the outer coating composition include colloidal silica solution (from the hydrolysis of tetraethyl orthosilicate in acidic solution, followed by neutralization in an alkaline medium) and photocatalytic anatase form of nano titanium oxide (typical particle size of 20 to 50 nm). The coating is subsequently sintered at an elevated temperature less than the decomposition temperature of the organic dye colorant. Since these nanoparticles and the coating do not alter the original color of the core granules, the resulting granules are green colored granules which possess photocatalytic functionality manufactured using the simple pan coating process. An intermediate barrier layer is applied between the core colored granules and the outer functional coating because certain colored granules require organic pigments to provide the particular color or hue for the end applications. Thus, an intermediate barrier of silica is employed to prevent degradation of the pigment by the photocatalytic nano-anatase particles incorporated in the outer layer.

Comparative Example 1

The process of Example 10 is repeated, except that the base white granules employed in Example 9 are substituted.

Various modifications can be made in the details of the various embodiments of the processes, compositions, and articles of the present invention, all within the scope and spirit of the invention and defined by the appended claims.

The invention claimed is:

1. A plurality of functionalized roofing granules, wherein each granule of the plurality of functionalized roofing granules comprising:

a base roofing granule;

a first coating layer disposed over the base roofing granule, the first coating layer including at least one coloring material disposed in a binder based on an alkali metal silicate;

a second coating layer disposed over the first coating layer, the second coating layer being a sodium ion barrier layer formed from silica glass or crystalline silicaceous material;

a transparent or translucent outer coating layer disposed over the second coating layer, the outer coating layer including photocatalytic anatase titanium dioxide having an average particle size less than 0.2 microns disposed in a binder based on colloidal silica or an organic polymer, the outer coating layer not including a binder based on an alkali metal silicate, an alkaline earth metal silicate, or a metal phosphate.

2. The plurality of functionalized roofing granules of claim 1, wherein the binder of the outer coating layer is based on colloidal silica.

3. The plurality of functionalized roofing granules of claim 1, wherein the binder of the outer coating is based on a polymer.

4. The plurality of functionalized roofing granules of claim 3, wherein the at least one organic polymer is selected from the group consisting of polyurethane polymers, acrylic polymers, polyurea polymers, silicone polymers, and siliconized polymers.

5. The plurality of functionalized roofing granules of claim 3, wherein the at least one organic polymer is an acrylic polymer.

6. The plurality of functionalized roofing granules of claim 1, made by a process comprising:

(a) providing base roofing granules having a first coating layer, the first coating layer including at least one coloring material disposed in a binder based on an alkali metal silicate; then (b) coating the base roofing granules with a second coating composition to form a second coating layer over the first coating layer, the second coating layer being a sodium ion barrier formed from silica glass or crystalline silicaceous material;

(c) curing the second coating composition having a second coating layer on the base roofing granules to form intermediate granules;

(d) coating the intermediate granules with a transparent or translucent outer coating composition, the outer coating composition comprising an outer coating binder and at least one functional material, the outer coating binder being one or more of colloidal silica and organic polymer, the outer coating not including a binder based on an alkali metal silicate, an alkaline earth metal silicate, or a metal phosphate, the at least one functional material being photocatalytic anatase titanium dioxide having an average particle size less than 0.2 microns; and (e) curing the outer coating composition to form a transparent or translucent outer coating layer on the base roofing granules.

7. The plurality of functionalized roofing granules of claim 6, wherein the binder of the outer coating layer is based on colloidal silica and wherein the outer coating layer is made by drying an outer coating composition comprising colloidal silica at an elevated temperature.

8. The plurality of functionalized roofing granules of claim 6, wherein the binder of the outer coating layer is based on colloidal silica and wherein the outer coating layer is made by drying an outer coating composition comprising colloidal silica at a temperature between about 20 and 80 degrees C.

9. The plurality of functionalized roofing granules of claim 6, wherein the binder of the outer coating layer is based on colloidal silica, and wherein the outer coating layer is made by drying an outer coating composition comprising colloidal silica prepared by treating a tetralkoxysilane, an organotrialkoxysilane and/or a siloxane oligomer with acid.

10. The plurality of functionalized roofing granules of claim 9, wherein the colloidal silica is prepared by treating one or more of tetramethoxysilane (TMOS), tetraethoxysilane (TEOS), tetra-n-propoxysilane, tetra-n-butoxysilane, tetrakis(2-methoxyethoxy)silane, methyltriethoxysilane (MTEOS), methyltrimethoxysilane, methyl tri-n-propoxysilane, phenyl triethoxysilane, vinyl triethoxysilane, hexamethoxydisiloxane, and octamethoxytrisiloxane with acid.

11. The plurality of functionalized roofing granules of claim 1, wherein the coloring material of the first coating layer comprises an organic compound or ligand.

12. The plurality of functionalized roofing granules of claim 1, wherein the coloring material of the first coating layer comprises a phthalocyanine derivative.

13. A roofing material comprising a bituminous upper surface, and disposed on the bituminous upper surface, the plurality of functionalized roofing granules of claim 1.

14. The roofing material of claim 13, further comprising a plurality of second roofing granules disposed on the bituminous upper surface.

15. A roofing material comprising a bituminous upper surface, and disposed on the bituminous upper surface, the plurality of functionalized roofing granules of claim 2.

16. A roofing material comprising a bituminous upper surface, and disposed on the bituminous upper surface, the plurality of functionalized roofing granules of claim 3.

17. A roofing material comprising a bituminous upper surface, and disposed on the bituminous upper surface, the plurality of functionalized roofing granules of claim 6.

18. A roofing material comprising a bituminous upper surface, and disposed on the bituminous upper surface, the plurality of functionalized roofing granules of claim 11.

* * * * *